US005604427A

United States Patent [19]

Kimura

[11] Patent Number: 5,604,427

[45] Date of Patent: Feb. 18, 1997

[54] CURRENT REFERENCE CIRCUIT USING PTAT AND INVERSE PTAT SUBCIRCUITS

[75] Inventor: Katsuji Kimura, Tokyo, Japan

[73] Assignee: NEC Corporation, Tokyo, Japan

[21] Appl. No.: 547,369

[22] Filed: Oct. 24, 1995

[30] Foreign Application Priority Data

Oct. 24, 1994 [JP] Japan ..... 6-257940

[51] Int. Cl.[6] ..... G05F 3/30

[52] U.S. Cl. ..... 323/313; 323/907

[58] Field of Search ..... 323/312, 313, 323/314, 315, 907

[56] References Cited

U.S. PATENT DOCUMENTS

| | | | |
|---|---|---|---|
| 4,628,248 | 12/1986 | Birrittella et al. | 323/314 |
| 5,029,295 | 7/1991 | Bennett et al. | 323/313 |
| 5,258,703 | 11/1993 | Pham et al. | 323/313 |

OTHER PUBLICATIONS

Y. Deval et al., "Ratiometric Temperature Stable Current Reference", *Electronics Letters*, vol. 29, No. 14, Jul. 8, 1993, pp. 1284–1285.

A. G. Van Lienden et al., "Latch-Up in Bipolar Low-Voltage Current Sources", *IEEE Journal of Solid-State Circuits*, vol. SC-22, No. 6, Dec. 1987, pp. 1139–1143.

K. Kimura, "Low Temperature Coefficient CMOS Voltage Reference Circuits", *IEICE Trans. Fundamentals*, vol. E77-A, No. 2, Feb. 1994, pp. 398–402.

*Primary Examiner*—Peter S. Wong
*Assistant Examiner*—Y. J. Han
*Attorney, Agent, or Firm*—Sughrue, Mion, Zinn, Macpeak & Seas

[57] ABSTRACT

A current reference circuit producing a reference current without temperature dependence and operating at a low supply voltage, which includes a first current source for producing a first constant current having a positive temperature coefficient, a second current source for producing a second constant current having a negative temperature coefficient, and an adder for adding the first and second constant currents to cancel their positive and negative temperature coefficients. The second current source contains first and second bipolar transistors and a resistor connected between a base and an emitter of the first bipolar transistor, and a bias subcircuit for supplying the reference current to the first bipolar transistor. The emitter of the first bipolar transistor is connected to an emitter of the second bipolar transistor, and a collector of the first bipolar transistor is connected to a base of the second bipolar transistor. The resistor is supplied with a current having a negative temperature coefficient. The second bipolar transistor is driven by a driving current having a negative temperature coefficient. A collector current of the second bipolar transistor acts as the second constant current.

18 Claims, 8 Drawing Sheets

CURRENT REFERENCE CIRCUIT USING PTAT AND INVERSE PTAT SUBCIRCUITS

BACKGROUND OF THE INVENTION

1. Field of the Invention

The present invention relates to a current reference circuit for producing a reference current and more particularly, to a current reference circuit using a proportional to absolute temperature (PTAT) subcircuit and an inverse PTAT subcircuit to produce a reference current with no temperature dependence.

2. Description of the Prior Art

A current reference circuit that enables to provide a reference current with no temperature dependence is typically composed of a current source producing a constant current whose current value increases in proportion to the ambient absolute temperature, which is termed a "PTAT" subcircuit, and another current source producing another constant current whose current value decreases in inverse proportion to the ambient absolute temperature, which is termed an "inverse PTAT" subcircuit. The two constant currents thus produced are added to cancel their temperature coefficients, resulting in the reference current with no temperature dependence.

FIG. 1 shows a conventional current reference circuit of this sort, which is disclosed in IEEE Electronics, 8th July, 1993, Vol. 29, No. 14.

In FIG. 1, two bipolar transistors Q51 and Q52 and a resistor R52 (1 kΩ) connected to an emitter of the transistor Q52 constitute a Widlar current source. A base and a collector of the transistor Q51 are coupled together. A base of the transistor Q52 is connected to the base of the transistor Q51. An emitter of the transistor Q52 is connected to the emitter of the transistor Q51 through the resistor R52. It is known well that the Widlar current source is a PTAT circuit that produces a constant current having a positive temperature coefficient.

Assuming that a resistor R53 (1 kΩ) connected to an emitter of a bipolar transistor Q53 has a resistance with no temperature dependency, a current flowing through the transistor Q53 has a positive temperature coefficient equal to that of the thermal voltage $V_T$, i.e., +3.333 pm/deg. Since the base of the transistor Q53 is connected to the coupled base and collector of the transistor Q51, and the base of the transistor Q52 is connected to the coupled base and collector of the transistor Q51, a current flowing through the transistor Q52 has a positive temperature coefficient of +3.333 pm/deg.

On the other hand, it is known that the base-emitter voltage of a transistor Q54 whose emitter has a resistor R54 (0.2 kΩ) has a negative temperature coefficient of about −2 mV/deg under the assumption that a current flowing through the transistor Q54 is a constant current with no temperature dependency. Therefore, the base potential of the transistor Q54 increases as the ambient temperature falls, which causes to increase the voltage drop generated by a resistor R55 (0.2 kΩ) connected to an emitter of a bipolar transistor Q55. Due to this increase of the voltage drop, a current flowing through the resistor R55 rises. Accordingly, the base potential of a transistor Q55 has a negative temperature coefficient whose absolute value is greater than about 2 mV/deg, which is due to the negative temperature coefficient of the transistor Q55 and the increase of the current flowing through the resistor R55, i.e., an emitter current of the transistor Q55. Thus, the base potential of the transistor Q55 has a temperature coefficient greater than about −2 mv/deg and less than about −4 mV/deg.

When the base potential of the transistor Q55 increases in inverse proportion to the ambient temperature, the base potential of a transistor Q56 whose base is connected to the base of the transistor Q55 increases at a temperature coefficient greater than about −2 mv/deg. On the other hand, since a constant current, which is produced by a current mirror circuit composed of bipolar transistors Q58 and Q59, flows through the transistor Q56, the base-emitter voltage of the transistor Q56 has a temperature coefficient of about −2 mV/deg less than the base potential of the transistor Q55. Therefore, the base-emitter voltage increase of the transistor Q56 is less than the base potential increase of the transistor Q55 and as a result, the emitter potential of the transistor Q56 becomes higher than the base potential of the transistor Q55 by the potential increase difference therebetween.

The constant current supplied by the current mirror circuit composed of the transistors Q58 and Q59 flows not only through the transistor Q56 but also through a resistor R56 connected to the emitter of the transistor Q56 and consequently, a voltage drop generated by the resistor R56 is kept constant. In consideration with this, as the emitter potential of the transistor Q56 increases due to the temperature fall, the base potential of a transistor Q57 whose base is connected to the end of the resistor R56 increases, in other words, a collector current of the transistor Q57 increases. This means that the collector current of the transistor Q57 has a negative temperature coefficient.

Assuming that the resistors R54, R55 and R56 have temperature-independent resistances, respectively, the collector current value of the transistor Q57 can be selected to have a temperature coefficient of −3.333 pm/deg by suitably selecting the resistance values of the respective resistors R54, R55 and R56. In this case, since the collectors of the transistors Q52 and Q57 are coupled together, the two collector currents of the transistors Q52 and Q57 are added to each other so that their temperature coefficients are cancelled. This enables to produce a constant current with no temperature dependency through the coupled collectors of the transistors Q52 and Q57.

Even if the resistors R54, R55 and R56 have respective resistance values with some temperature dependency, the sum of the collector currents of the transistors Q52 and Q57 can be temperature-independent by suitably selecting the resistance values of the respective resistors R54, R55 and R56.

The temperature-independent sum current thus generated at the coupled collectors of the transistors Q52 and Q57 is supplied to the transistor Q54 and the resistor R54 through the current mirror circuit composed of the transistors Q58 and Q59As a result, it is confirmed that the above assumption of the current flowing through the transistor Q54 having no temperature coefficient is correct.

The temperature-independent constant current, which is the sum of the collector currents of the transistors Q52 and Q57, is taken out from a bipolar transistor Q60 whose base is connected to the coupled bases of the transistors Q58 and 59 as an output current $I_{out}$ of the conventional current reference circuit.

As described above, the collector current of the transistor Q52 as the output current of the PTAT subcircuit, which contains the Widlar current source, and the collector current of the transistors Q57 as the output current of the inverse PTAT subcircuit, which contains the transistors Q54, Q55 and Q56 and the emitter resistors R54, R55 and R56, are added to each other, producing the temperature-independent reference current.

With the conventional current reference circuit shown in FIG. 1, the transistors Q55 and Q56 are essential to constitute the inverse PTAT subcircuit and therefore, the number of the vertically stacked transistors becomes large. This means that this circuit cannot be operated at a satisfactorily low supply voltage such as 3 V.

SUMMARY OF THE INVENTION

Accordingly, an object of the present invention is to provide a current reference circuit that can produce a reference current without temperature dependence and that can be operated at a lower supply voltage than that of the conventional one.

A current reference circuit according to a first aspect of the invention includes (a) a first current source for producing a first constant current having a positive temperature coefficient; (b) a second current source for producing a second constant current having a negative temperature coefficient; and (c) an adder for adding the first and second constant currents to cancel their positive and negative temperature coefficients, producing a reference current having no temperature dependence.

The first current source may be made of any current source that can produce a constant current with a positive temperature coefficient.

In a preferred embodiment, the first current source is made of a Nagata current source or a Widlar current source.

The second current source contains a first bipolar transistor, a second bipolar transistor, a resistor connected between a base and an emitter of the first bipolar transistor, and a bias subcircuit for supplying the reference current to the first bipolar transistor through its collector. The emitter of the first bipolar transistor is connected to an emitter of the second bipolar transistor, and a collector of the first bipolar transistor is connected to a base of the second bipolar transistor.

The resistor is supplied with a current having a negative temperature coefficient. The second bipolar transistor is driven by a driving current having a negative temperature coefficient. A collector current of the second bipolar transistor acts as the second constant current having the negative temperature coefficient.

With the current reference circuit according to the first aspect of the invention, the first bipolar transistor is supplied with the reference current having no temperature dependency through its collector by the bias subcircuit in the second current source. Therefore, as already described above for the conventional current reference circuit, the base-emitter voltage of the first transistor has a negative temperature coefficient (for example, −2 mV/deg).

Also, if the base-emitter voltage of the first transistor increases due to temperature lowering, the current flowing through the resistor increases. As a result, the current flowing through the resistor has a negative temperature coefficient.

Further, because the second bipolar transistor is driven by the driving current having the negative temperature coefficient, the collector current of the second bipolar transistor has a negative temperature coefficient. This means that the collector current can act as the second constant current of the second current source.

As a result, if the collector current of the second bipolar transistor as the second constant current has a negative temperature-coefficient value that is selected to cancel the positive temperature-coefficient value of the first constant current, the reference current can be made independent of the temperature.

Thus, the current reference circuit according to the first aspect of the invention has the number of the vertically stacked transistors limited to two even if the bias subcircuit is contained, which enables to be operated at a lower supply voltage than that of the conventional one.

In a preferred embodiment of the current reference circuit according to the first aspect, there are third and fourth bipolar transistors that constitute a current mirror subcircuit, and the current flowing through the resistor has the same temperature-coefficient value as that of the driving current for the second bipolar transistor. In this case, the driving current having the negative temperature coefficient can be readily realized.

A current reference circuit according to a second aspect of the invention has the same basic configuration made of the first current source, the second current source and the adder as that of the first aspect.

The first current source contains a first bipolar transistor, a first resistor connected between a base and a collector of the first bipolar transistor, a second bipolar transistor whose base is connected to the collector of the first bipolar transistor, a third bipolar transistor whose base is connected to a collector of the second bipolar transistor, emitters of the first, second and third bipolar transistors being coupled together, and a first bias subcircuit for supplying a first current to the first bipolar transistor through its collector, a second current to the second bipolar transistor through its collector, and a third current to the third bipolar transistor through its collector.

The first and second bipolar transistors constitute a Nagata current source. The first constant current having the positive temperature coefficient is taken out from the third bipolar transistor through the first bias subcircuit.

The second current source contains a fourth bipolar transistor, a fifth bipolar transistor, a second resistor connected between a base and an emitter of the fourth bipolar transistor, and a second bias subcircuit for supplying the reference current to the fourth bipolar transistor through its collector. The emitter of the fourth bipolar transistor is connected to an emitter of the fifth bipolar transistor, and a collector of the fourth bipolar transistor is connected to a base of the fifth bipolar transistor.

The second resistor is supplied with a current having a negative temperature coefficient. The fifth bipolar transistor is driven by a driving current having a negative temperature coefficient. A collector current of the fifth bipolar transistor acts as the second constant current having the negative temperature coefficient.

With the current reference circuit according to the second aspect of the invention, the first and second bipolar transistors constitute the Nagata current source, which provides a constant current having a positive temperature coefficient through the collector of the second bipolar transistor. Since the collector of the third bipolar transistor is connected to the base of the third bipolar transistor, a constant current having a positive temperature coefficient acting as the first constant current can be produced through the third bipolar transistor.

Because the second current source has the same configuration as that of the current reference circuit according to the first aspect, the collector current of the fifth bipolar transistor acts as the second constant current with the negative temperature coefficient.

As a result, if the collector current of the fifth bipolar transistor as the second constant current has a negative temperature-coefficient value that is selected to cancel the positive temperature-coefficient value of the first constant current, the reference current can be made independent of the temperature.

Thus, the current reference circuit according to the second aspect of the invention also has the number of the vertically stacked transistors limited to two even if the first and second bias subcircuits are contained, which enables to be operated at a lower supply voltage than that of the conventional one.

A current reference circuit according to a third aspect of the invention has the same basic configuration made of the first current source, the second current source and the adder as that of the first aspect. The current reference circuit according to the third aspect has the same configuration as that of the second aspect except that the first current source is different in structure from that of the second aspect.

With the current reference circuit according to the third aspect, the first current source contains a first bipolar transistor whose base and collector are coupled together, a second bipolar transistor whose base is connected to the coupled base and collector of the first bipolar transistor, a first resistor connected to an emitter of the second bipolar transistor, a third bipolar transistor whose base is connected to a collector of the second bipolar transistor.

The emitter of the second bipolar transistor is connected to emitters of the first and third bipolar transistors through the first resistor, and a first bias subcircuit for supplying a first current to the first bipolar transistor through its collector, a second current to the second bipolar transistor through its collector, and a third current to the third bipolar transistor through its collector.

The first and second bipolar transistors constitute a Widlar current source. The first constant current having the positive temperature coefficient is taken out from the third bipolar transistor through the first bias subcircuit.

With the current reference circuit according to the third aspect of the invention, the first and second bipolar transistors constitute the Widlar current source, which provides a constant current having a positive temperature coefficient through the collector of the second bipolar transistor. Since the collector of the third bipolar transistor is connected to the base of the third bipolar transistor, a constant current having a positive temperature coefficient acting as the first constant current can be produced through the third bipolar transistor.

As a result, the same effect or advantage as that of the circuit according to the second aspect can be obtained.

In a preferred embodiment of the current reference circuits according to the second and third aspects, a voltage drop generated at the first resistor due to the first bias current supplied from the first bias subcircuit to the first bipolar transistor is substantially equal to the thermal voltage. The second bias current in the Nagata current source has a peaking characteristic, and the Nagata current source can be operated at the peak of the characteristic if the voltage drop generated at the first resistor is substantially equal to the thermal voltage. Since the changing rate of the second bias current relative to the first bias current becomes minimum at the peak, the operation of the current reference circuits can stabilized.

In another preferred embodiment of the current reference circuits according to the second and third aspects, the second bipolar transistor has an emitter area of K times as large as that of the first bipolar transistor, where K is substantially equal to the base of the natural logarithm, i.e., e. Also, the current values of the first and second bias current are equal to each other. In this case, the operation of the Nagata current source can be stabilized since the Nagata current source operates stably near the peak of its characteristic.

In still another preferred embodiment of the current reference circuits according to the second and third aspects, the first bias subcircuit further contains a sixth bipolar transistor whose base and collector are coupled together, a seventh bipolar transistor, and an eighth bipolar transistor. The sixth bipolar transistor supplies the third bias current to the third bipolar transistor, the seventh bipolar transistor supplies the second bias current to the second bipolar transistor, and the eighth bipolar transistor supplies the first bias current to the third bipolar transistor. The eighth bipolar transistor has an emitter area of (11/4) times as that of the second bipolar transistor. In this case, the operation of the Nagata current source can be stabilized since the Nagata current source operates near the peak of its characteristic.

In the current reference circuits according to the first to third aspects, the first to eighth bipolar transistors are employed. However, these bipolar transistors can be replaced by field-effect transistors (FETs), respectively.

When the FETs are employed, the gate-source voltage of the FET produced by the popular fabrication processes typically has a negative temperature coefficient of about −2.3 mV/deg, which is almost equivalent to that of the bipolar transistor. Therefore, the FETs also enables to provide the current reference circuit according to the invention.

In the case of the FETs, the first FET preferably has a gate-width to gate-length ratio (W/L) of four times as large as that of the second FET. Thus, the Nagata current source composed of the FETs is operated near the peak of its characteristic, enabling to stabilize the circuit operation.

DETAILED DESCRIPTION OF THE PREFERRED EMBODIMENTS

Figure 1:
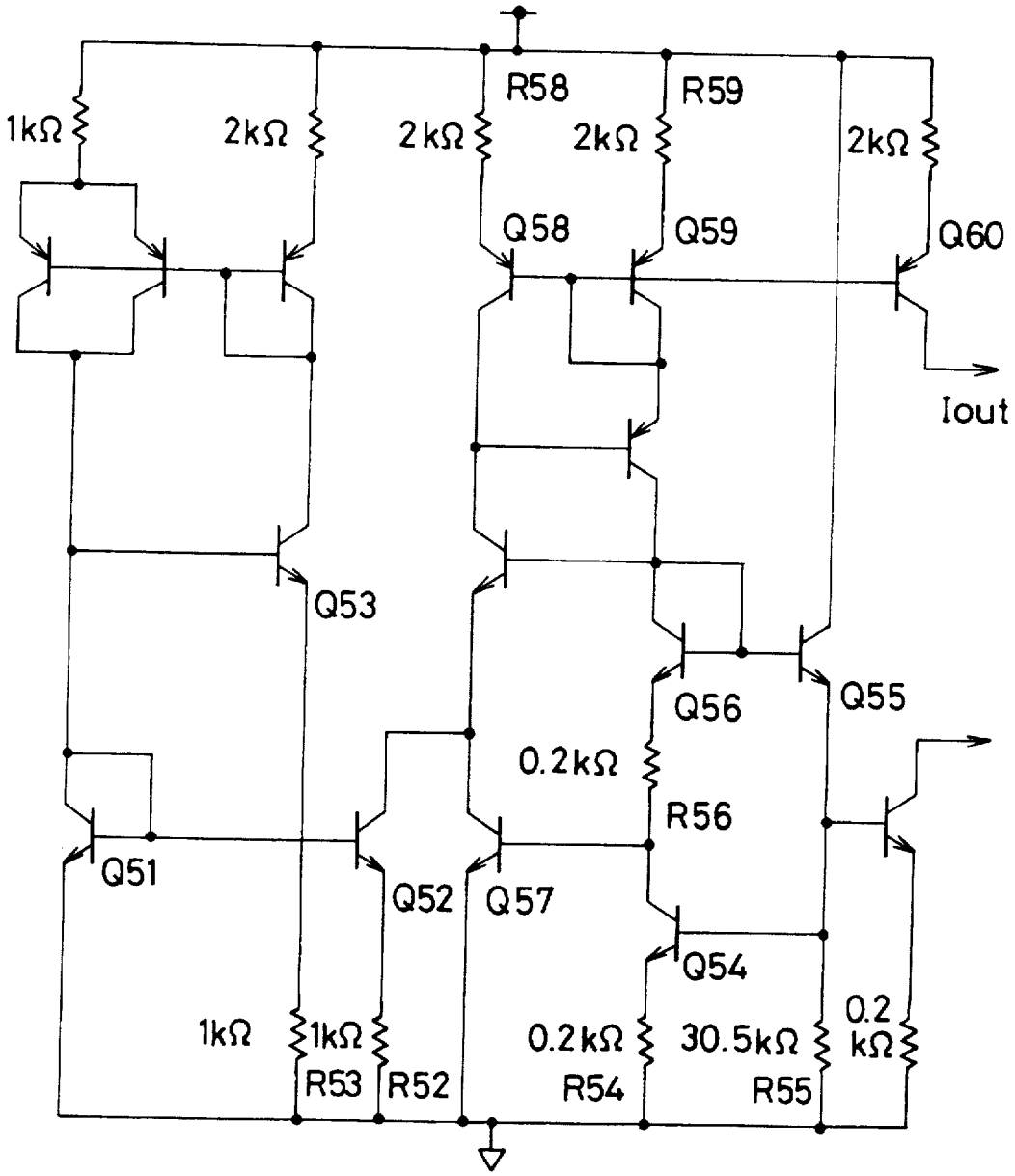
FIG. 1 PRIOR ART
FIG. 1 is a circuit diagram of a conventional current reference circuit.

Preferred embodiments of the present invention will be described below while referring to the drawings attached.

FIRST EMBODIMENT

Figure 2:
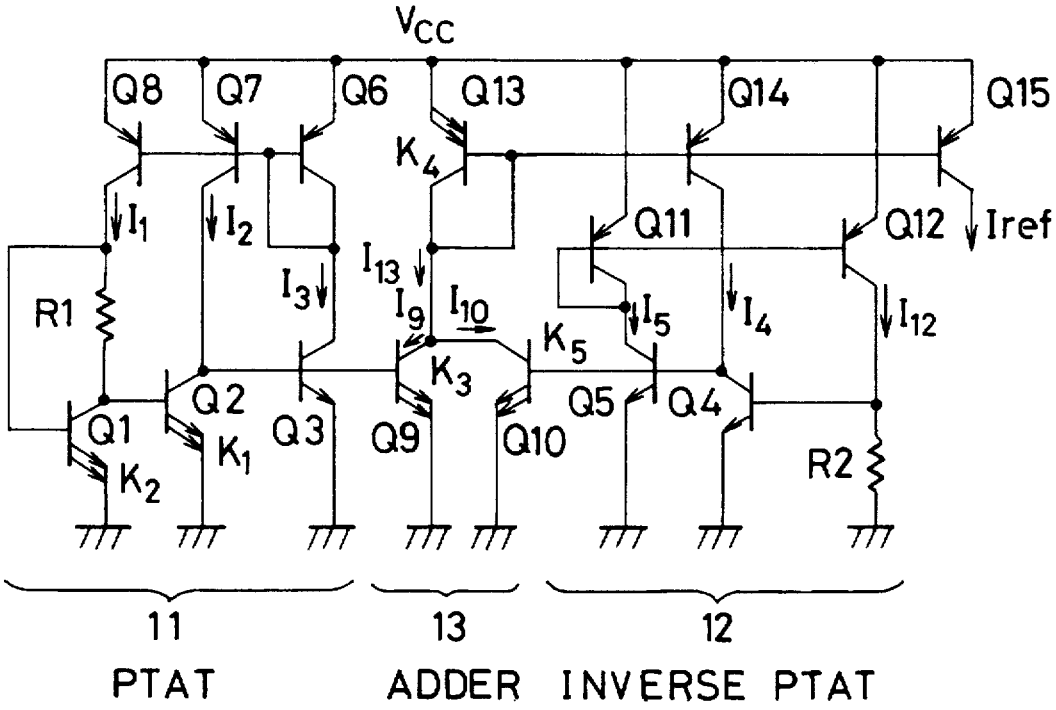
FIG. 2 is a circuit diagram of a current reference circuit composed of bipolar transistors according to a first embodiment of the invention, in which a Nagata current mirror is employed.

A current reference circuit according to a first embodiment has a configuration as shown in FIG. 2, which includes a PTAT current source 11, an inverse PTAT current source 12 and an adder 13.

The PTAT current source 11 produces a first constant current having a positive temperature coefficient. The current value of the first constant current varies in proportion to the ambient absolute temperature.

The inverse PTAT current source 12 produces a second constant current having a negative temperature coefficient. The current value of the second constant current varies in inverse proportion to the ambient absolute temperature.

The adder 13 receives and adds the first and second constant currents to cancel their positive and negative temperature coefficients, producing a reference current $I_{ref}$ having no temperature dependence.

The PTAT current source 11 includes a current mirror subcircuit composed of two npn bipolar transistors Q1 and Q2 and one resistor R1 (resistance: $r_1$), another current mirror subcircuit composed of three pnp bipolar transistors Q6, Q7 and Q8, and an npn bipolar transistor Q3 connected to the two current mirror subcircuits.

The current mirror subcircuit made of the transistors Q1 and Q2 and the resistor R1 produces a constant current with a positive temperature coefficient. The transistor Q3 is used to take out the constant current from this current mirror subcircuit. The current mirror subcircuit made of the transistors Q6, Q7 and Q8 supplies bias currents to the respective transistors Q1, Q2 and Q3. The bias currents have the same current value.

In the current mirror subcircuit made of the transistors Q1 and Q2 and the resistor R1, the resistor R1 is connected between a base and a collector of the transistor Q1, so that the base and collector of the transistors are connected to each other through the resistor R1. An emitter of the transistor Q1 is grounded. The collector of the transistor Q1 is connected to a base of the transistor Q2. An emitter of the transistor Q2 is grounded and a collector thereof is connected to a base of the transistor Q3. An emitter of the transistor Q3 is grounded.

The transistor Q3 is made of a unit bipolar transistor. The transistor Q1 has an emitter area of $K_2$ times as large as that of the unit transistor, where $K_2$ is a constant greater than unity. The transistor Q2 has an emitter area of $K_1$ times as large as that of the unit transistor, where $K_1$ is a constant greater than unity.

In the current mirror subcircuit made of the transistors Q6, Q7 and Q8, bases of the transistors Q6, Q7 and Q8 are connected in common. A collector of the transistor Q8 is connected to the connection point of the resistor R1 and the base of the transistor Q1. A collector of the transistor Q7 is connected to the collector of the transistor Q2. The base and a collector of the transistor Q6 are coupled together to be connected to a collector of the transistor Q3. Emitters of the transistors Q6, Q7 and Q8 are connected in common to be applied with a supply voltage $V_{cc}$.

Each of the transistors Q6, Q7 and Q8 is made of a unit bipolar transistor.

The current mirror subcircuit composed of the transistors Q1 and Q2 and the resistor R1 is termed here a "Nagata current mirror" subcircuit to distinguish it from a well-known "Widlar current mirror" subcircuit. The Nagata current mirror subcircuit was created by M. Nagata and was disclosed in detail in the Japanese Examined Patent Publication No. 46-16463 published on May 6, 1971.

From the principle of the Nagata current mirror subcircuit, it is clear that an additional resistor may be connected to the emitter of the transistor Q1 and/or another additional resistor may be connected to the emitter of the transistor Q2. However, in this embodiment, only one resistor R1 is provided between the base and the collector of the transistor Q1 in order to represent the feature of the Nagata current mirror subcircuit remarkably.

In this Nagata current mirror subcircuit, a collector current I1 of the transistor Q1 is used as a reference to a collector current $I_2$ of the transistor Q2 as an output of this subcircuit. The currents $I_1$ and $I_2$ are equal in current value to each other, i.e., $I_1=I_2$. The current $I_2$ is a constant current having a positive temperature coefficient. The numeral $I_3$ indicates a collector current of the transistor Q3. Here, $I_3=I_1=I_2$ is established.

The inverse PTAT subcircuit 12 includes two npn bipolar transistors Q4 and Q5 and one resistor R2 (resistance: $r_2$). The resistor R2 is connected between a base of the transistor Q4 and the ground. Emitters of the transistors Q4 and Q5 are connected to the ground. A collector of The transistor Q4 is connected to a base of the transistor Q5.

The inverse PTAT subcircuit 12 further includes five pnp bipolar transistors Q11, Q12, Q13, Q14 and Q15. The transistors Q11 and Q12 constitute a current mirror subcircuit, and the transistors Q13, Q14 and Q15 constitute another current mirror subcircuit.

Bases of the transistors Q11 and Q12 are coupled together. A collector and the base of the transistor Q11 are coupled together to be connected to a collector of the transistor Q5. A collector of the transistor Q12 is connected to the connection point of the resistor R2 and the base of the transistor Q4. Emitters of the transistors Q11 and Q12 are applied with the supply voltage Vcc.

Bases of the transistors Q13, Q14 and Q15 are coupled together. A collector and the base of the transistor Q13 are coupled together. A collector of the transistor Q14 is connected to the collector of the transistor Q4. Emitters of the transistors Q13, Q14 and Q15 are applied with the supply voltage Vcc.

The reference current $I_{ref}$ with no temperature dependency of this current reference circuit is taken out from a collector of the transistor Q15.

Each of the transistors Q11, Q12, Q14 and Q15 is made of a unit bipolar transistor. The transistor Q13 has an emitter area of $K_4$ times as large as that of the unit transistor, where $K_4$ is a constant greater than unity.

In the current mirror circuit composed of the transistors Q11 and Q12, a collector current $I_{12}$ of the transistor Q12, which flows through the resistor R2, has a current value and a temperature coefficient that are equal to those of a collector current of the transistor Q11, i.e., the collector current $I_5$ of the transistor Q5. In other words, the transistor Q5 is supplied with the current $I_5$ having the same current value and negative temperature coefficient as those of the current flowing through the resistor R2. The current flowing through the resistor R2, i.e., $I_{12}$, has a negative temperature coefficient (the reason of which is shown below) and therefore, the current $I_5$ has the same negative temperature coefficient.

In the current mirror circuit composed of the transistors Q13, Q14 and Q15, each of collector currents of the transistors Q14 and Q15 has a current value and a temperature coefficient that are equal to those of a collector current $I_{13}$ of the transistor Q13. In other words, the transistor Q14 supplies a bias current having the same current value and temperature coefficient as those of the collector current $I_{13}$ as the collector current $I_4$. Also, a collector current of the transistor Q15 has the same current value and temperature coefficient as those of the collector current $I_{13}$, which is the reference current $I_{ref}$ of this current reference circuit.

Since the collector current $I_{13}$ has no temperature coefficient (the reason of which is shown below), both of the collector current $I_4$ and the reference current $I_{ref}$ have no temperature coefficient.

The adder 13 contains two npn bipolar transistors Q9 and Q10 whose collectors are coupled together to be connected to the collector of the transistor Q13 and whose emitters are grounded. A base of the transistor Q9 is connected to the base of the transistor Q3 and the collector of the transistor Q2. A base of the transistor Q10 is connected to the base of the transistor Q5 and the collector of the transistor Q4.

The transistor Q9 has an emitter area of K3 times as large as that of the unit transistor, and the transistor Q10 has an emitter area of $K_5$ times as large as that of the unit transistor, where $K_4$ and $K_5$ are constants greater than unity.

The transistor Q9 is driven by the constant current $I_2$ having the positive temperature coefficient through the transistor Q3, producing the current $I_9$ having the positive temperature coefficient as the output of the PTAT current source 11. In other words, the collector current $I_9$ is the first constant current having the positive temperature. coefficient produced by the PTAT current source 11.

On the other hand, the transistor Q10 is driven by the constant current $I_{12}$ having the negative temperature coefficient through the transistors Q4 and Q5, producing the current $I_{10}$ having the negative temperature coefficient as the output of the inverse PTAT current source 12. In other words, the collector current $I_{10}$ is the second constant current having the negative temperature coefficient produced by the inverse PTAT current source 12.

Since the collectors of the transistors Q9 and Q10 are coupled together to be connected to the collector of the transistor Q13, the collector currents $I_9$ and $I_{10}$ are added to each other to cancel their positive and negative temperature coefficients with each other. Thus, the current I13 as the sum current of the currents $I_9$ and $I_{10}$ has no temperature coefficient, in other words, no temperature dependence.

Since the currents $I_4$ and $I_{ref}$ are mirror currents of the current $I_{13}$ having no temperature coefficient, the temperature-independent current $I_4$ is supplied to the transistor Q4 and at the same time, the temperature-independent current $I_{ref}$ is outputted from the collector of the transistor Q15 as the reference current of this current reference circuit.

Next, the reason that the PTAT current source 11 produces the constant current $I_9$ having the positive temperature coefficient and that the inverse PTAT current source 12 produces the constant current $I_{10}$ having the negative temperature coefficient is described below.

Supposing that all the bipolar transistors are matched in characteristic and ignoring the basewidth modulation (or, the Early effect), a collector current $I_i$ of each transistor whose emitter area is $K_i$ times as large as that of the unit transistor can be expressed as the following equation (1).

$$I_{Ci} = K_i I_S \exp\left(\frac{V_{BEi}}{V_T}\right) \tag{1}$$

In the equation (1), $V_T$ is the thermal voltage of each transistor defined as $V_T=(kT)/q$ where k is the Boltzmann's constant, T is absolute temperature in degrees Kelvin, and q is the charge of an electron. Also, $I_s$ is the saturation current of each transistor, $V_{BEi}$ is a base-emitter voltage of each transistor.

In the current reference circuit of the first embodiment, the transistor Q1 has the emitter area of $K_2$ ($K_2>1$) times as large as that of the unit transistor, and the transistor Q2 has an emitter area of $K_1$ ($K_1>1$) times as large as that of the unit transistor. Therefore, the following equations (2) and (3) are established.

$$I_1 = K_2 I_S \exp\left(\frac{V_{BE1}}{V_T}\right) \tag{2}$$

$$I_2 = K_1 I_S \exp\left(\frac{V_{BE2}}{V_T}\right) \tag{3}$$

Here, the collector currents $I_1$ and $I_2$ are equal to each other, i.e., $I_1=I_2$. Therefore, the difference $\Delta V_{BE}$ between base-emitter voltages $V_{BE1}$ and $V_{BE2}$ of the transistors Q1 and Q2 is expressed by the following equation (4).

$$\Delta V_{BE} = V_{BE1} - V_{BE2} = V_T \ln\left(\frac{K_1}{K_2}\right) = r_1 I_1 \tag{4}$$

Here, for the sake of the simplification of description, the dc common-base current gain factor $\alpha_F$ is set to be unity, i.e., $\Delta_F=1$.

From the equation (4), the current $I_1$ can be shown by the following expression (5).

$$I_1 = \frac{V_T}{r_1} \ln\left(\frac{K_1}{K_2}\right) = \frac{kT}{qr_1} \ln\left(\frac{K_1}{K_2}\right) \tag{5}$$

The temperature coefficient of the thermal voltage $V_T$ is about +3.333 ppm/deg. Therefore, if the temperature coefficient of the resistor R1 is less than about +3.333 ppm/deg, the temperature coefficient of the collector current $I_1$ is positive, which means that the current $I_1$ varies in proportion to the ambient absolute temperature T.

Because a resistor having a temperature coefficient less than about +3.333 ppm/deg can be realized through typical fabrication processes of the semiconductor devices, the current $I_1$ having such the temperature coefficient can be obtained readily. The collector current $I_1$ is a mirror current of $I_1$ and therefore, the PTAT current source 11 can practically produce the first constant current $I_9$ having the PTAT characteristic.

Next, since $V_{BE1}-V_{BE2}=r_1 \cdot I_1$ is established, the current $I_2$ can be shown by the following expression (6).

$$I_2 = K_1 I_1 \exp\left(-\frac{r_1 I_1}{V_T}\right) \tag{6}$$

Figure 3:
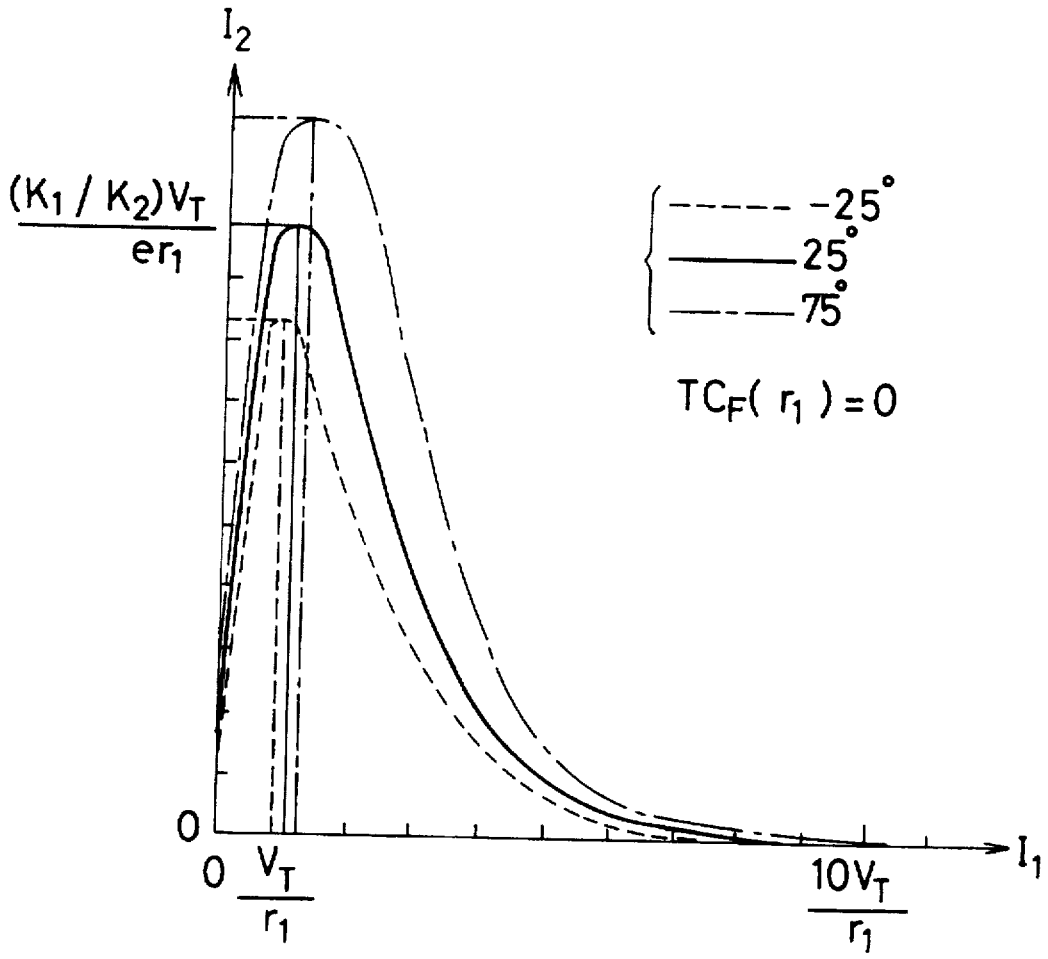
FIG. 3 is a graph showing the relationship between the currents $I_1$ and $I_2$ of the PTAT subcircuit in the current reference circuit of FIG. 2.

FIG. 3 is a graph showing the relationship between the currents $I_1$ and $I_2$ in the bipolar Nagata current mirror subcircuit, which is obtained by using the expression (6).

It is seen from FIG. 3 that the mirror current $I_2$ varies with respect to the reference current $I_1$ and that the curve of $I_2$ has a peak. The peak appears when the voltage drop ($=r_1 \cdot I_1$) generated by the resistor R1 is equal to the thermal voltage $V_T$. If the current $I_1$ has a current value that is positioned at the peak by selecting the resistance value $r_1$ of the resistor R1, the fluctuation for the current I1 with respect to the current $I_1$ becomes the least, resulting in the most stable operation of the Nagata current mirror subcircuit.

Also, $I_1=I_2$ is established in this embodiment, $(V_T/r_1)=(K_1/K_2)(V_T/e\cdot r_1)$ is established at the peak of the $I_1$ curve. Therefore, it is preferable that the ratio $(K_1/K_2)$, which indicates an emitter area ratio of the transistors Q1 and Q2, is equal to the base of the natural logarithm, i.e., e (=2.71828 . . . ), because the Nagata current mirror subcircuit can operate at the peak of the $I_1$ curve.

In this embodiment, the ratio $(K_1/K_2)$ is equal to (11/4) as an approximation to the base e, in other words, $K_1=11$ and $K_2=4$. Therefore, the Nagata current mirror subcircuit operates near the peak. This provides its considerably stable and satisfactory operation.

The same result can be obtained if $K_1=1$ and $K_2=4/11$ or $K_1=11/4$ and $K_2=1$.

Next, the reason that the inverse PTAT current source 12 produces the constant current $I_{10}$ having the negative temperature coefficient is described.

Assuming that the current $I_4$ flowing through the transistor Q4 has no temperature coefficient, in other words, the current $I_4$ is independent of the ambient absolute temperature T, the base-emitter voltage of the transistor Q4 has a negative temperature coefficient of about −2 mV/deg.

For example, when the resistor R2 has no temperature coefficient and the base-emitter voltage of the transistor Q4 at room temperature is 600 mv, the current $I_{12}$ flowing through the resistor R2 has a negative temperature coefficient of (−2 mv/600 mV)=−3.333 ppm/deg.

Because the bases of the transistors Q11 and Q12 are coupled together to constitute the current mirror subcircuit, the current $I_5$ flowing through the transistor Q5 is a mirror current of the current $I_{12}$ flowing through the resistor R2. This means that the current $I_5$ also has a negative temperature coefficient equal to that of the current $I_{12}$.

As described above, the collector current $I_2$ as the first constant current of the PTAT current source 11 has a positive temperature coefficient and the collector current $I_5$ as the second constant current of the inverse PTAT current source 12 has a negative temperature coefficient. The currents $I_9$ and $I_{10}$ having the positive and negative temperature coefficients equal to those of the currents $I_2$ and $I_{12}$ are added in the adder 13 to cancel their coefficients, resulting in the current $I_9$ having no temperature coefficient.

Because the bases of the transistors Q13 and Q14 are coupled together to constitute the current mirror subcircuit, the current $I_4$ flowing through the transistors Q4 and Q14 and the reference current Iref are mirror currents of the current $I_{13}$ flowing through the transistor Q13. Therefore, the currents $I_4$ and $I_{ref}$ have no temperature coefficient. This means that the above assumption that the current $I_4$ has no temperature coefficient is correct.

Even when the resistor R2 has any temperature coefficient, the temperature coefficient of the current $I_{13}$ can be cancelled if the current $I_4$ flowing through the transistor Q4. Specifically, if the emitter area ratios $K_3$, $K_4$ and $K_5$ of the transistor Q9, Q13 and Q10 have respective values selected adaptively.

It can be said that the inverse PTAT current source 12 produces the second constant current having the negative temperature coefficient in the following way:

In consideration with the fact that the base-emitter voltage of the transistor Q4 has a negative temperature coefficient, the current $I_{12}$ having a negative temperature coefficient is produced by using the resistor R2 connected to the base of the transistor Q4. Then, the negative temperature coefficient of the current $I_{12}$ thus produced is transferred to the current I5 flowing through the transistor Q5 using the transistors Q11 and Q12.

The temperature-independent reference current $I_{ref}$ is produced by using the transistors Q4 and Q5 arranged horizontally and the resistor R2, in other words, no vertically stacked transistors are required for producing such the current $I_{ref}$, which is unlike in the conventional current reference circuit.

As a result, with the current reference circuit according to the first embodiment, the number of the vertically stacked transistors limited to two even if the bias subcircuit made of the transistors Q13 and Q14 is contained, enabling to operate the current reference circuit at a lower supply voltage than that of the conventional one.

SECOND EMBODIMENT

Figure 4:
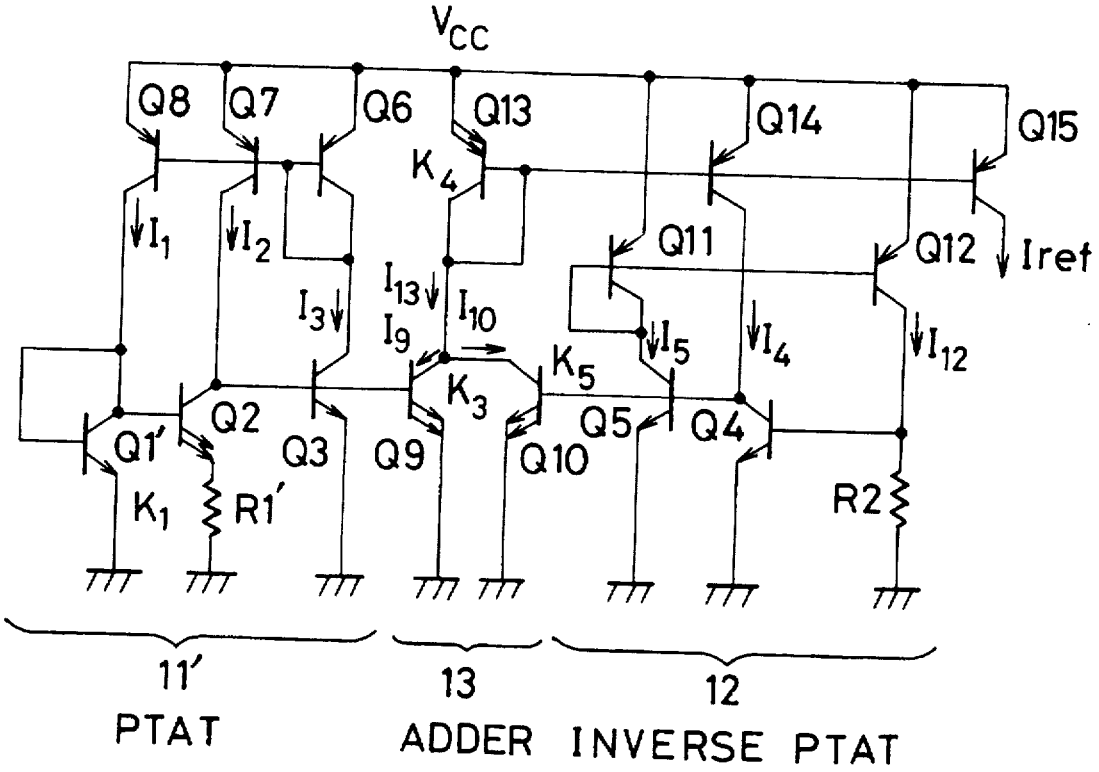
FIG. 4 is a circuit diagram of a current reference circuit composed of bipolar transistors according to a second embodiment of the invention, in which a Widlar current mirror is employed.

A current reference circuit according to a second embodiment is shown in FIG. 4, which has the same configuration as that of the first embodiment except that the "Nagata current mirror" subcircuit is replaced by a "Widlar current mirror" subcircuit in which the transistor Q1 whose emitter area ratio with respect to the unit transistor is $K_2$ is replaced by a pnp bipolar transistor Q1' whose emitter area ratio is unity.

Therefore, description for the same configuration is omitted here by adding the same reference numerals to the corresponding elements for the sake of simplification.

In FIG. 4, a PTAT current source 11' includes a Widlar current mirror subcircuit composed of two npn bipolar transistors Q1' and Q2 and one resistor R1' (resistance: $r_1'$), another current mirror subcircuit composed of three pnp bipolar transistors Q6, Q7 and Q8, and an npn bipolar transistor Q3. The resistor R1' is connected between the emitter of the transistor Q2 and the ground. The resistor R1 connected to the collector of the transistor Q1' in the first embodiment is not provided here.

The PTAT current source 11' also produces a first constant current having a positive temperature coefficient and a current value varying in proportion to the ambient absolute temperature.

The PTAT subcircuit containing the Widlar current mirror subcircuit produces such the first constant current according to a well-known procedure or principle and therefore, no description relating to the procedure is shown here. This procedure is disclosed in detail in IEEE Journal of solid-State Circuits, vol. SC-22, No. 6, pp. 1139–1143, Dec. 1987.

As seen from the second embodiment, the current reference circuit of the present invention can be realized by using not only a Nagata current mirror subcircuit but also a Widlar current mirror subcircuit. However, the Nagata current mirror subcircuit enables to calculate the values of the currents $I_1$ and $I_2$ readily; consequently, it is more advantageous than the Widlar current mirror subcircuit on circuit design.

THIRD EMBODIMENT

Although bipolar transistors are employed in the first and second embodiments, any field-effect transistors (FETs) such as metal-oxide-semiconductor FETs (MOS FETs) may be employed in the present invention.

Figure 5:
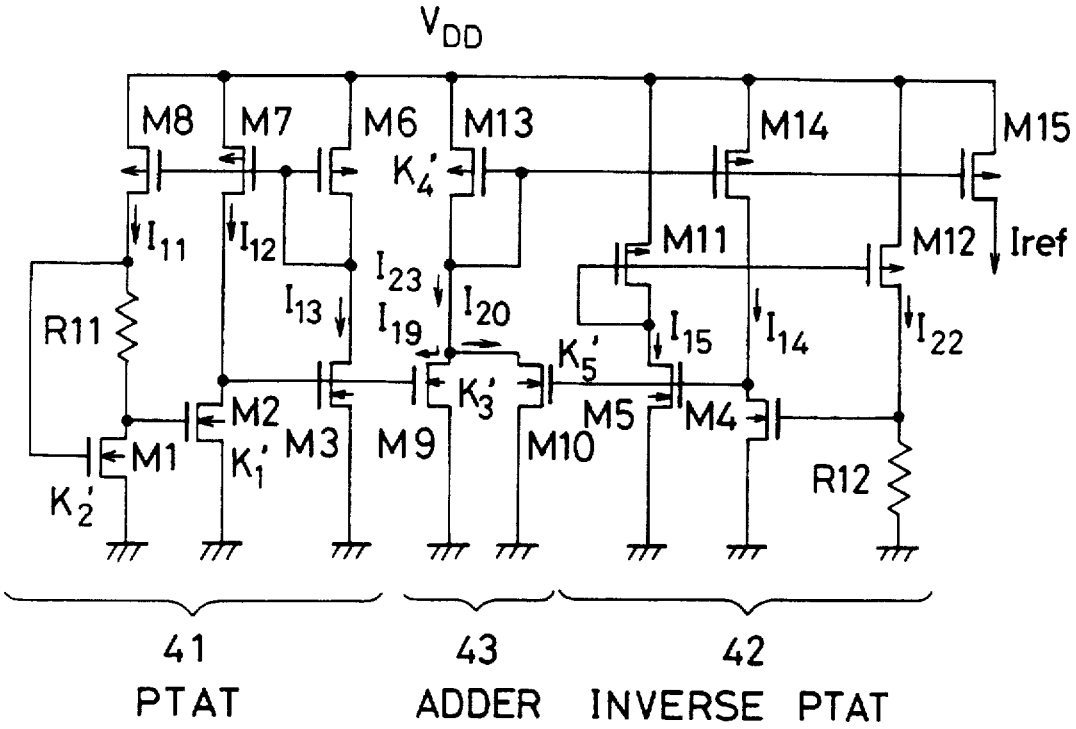
FIG. 5 is a circuit diagram of a current reference circuit composed of MOSFETs according to a third embodiment of the invention, which is equivalent to a circuit obtained by replacing the bipolar transistors in the circuit of FIG. 2 by MOSFETs.

FIG. 5 shows a current reference circuit according to a third embodiment, which has the same configuration as that of the first embodiment except that the bipolar transistors are replaced by MOSFETs, respectively.

As shown in FIG. 5, the current reference circuit according to the third embodiment includes a PTAT current source 41, an inverse PTAT current source 42 and an adder 43.

The PTAT current source 41 produces a first constant current having a positive temperature coefficient. The current value of the first constant current varies in proportion to the ambient absolute temperature.

The inverse PTAT current source 42 produces a second constant current having a negative temperature coefficient. The current value of the second constant current varies in inverse proportion to the ambient absolute temperature.

The adder 43 receives and adds the first and second constant currents to cancel their positive and negative temperature coefficients, producing a reference current Iref having no temperature dependence.

The PTAT current source 41 includes a current mirror subcircuit composed of two n-channel MOSFETs M1 and M2 and one resistor R11 (resistance: $r_{11}$), another current mirror subcircuit composed of three p-channel MOSFETs M6, M7 and M8, and an n-channel MOSFET M3 connected to the two current mirror subcircuits.

The current mirror subcircuit made of the MOSFETs M1 and M2 and the resistor R11 produces a constant current with a positive temperature coefficient. The MOSFET M3 is used to take out the constant current from this current mirror subcircuit. The current mirror subcircuit made of the MOSFETs M6, M7 and M8 supplies bias currents to the respective MOSFETs M1, M2 and M3. The bias currents have the same current value.

In the current mirror subcircuit made of the MOSFETs M1 and M2 and the resistor R11, the resistor R11 is connected between a gate and a drain of the MOSFET M1, so that the gate and drain of the MOSFET M1 are connected to each other through the resistor R11. A source of the MOSFET M1 is grounded. The drain of the MOSFET M1 is connected to a gate of the MOSFET M2. A source of the MOSFET M2 is grounded and a drain thereof is connected to a gate of the MOSFET M3. A source of the MOSFET M3 is grounded.

The MOSFET M1 has a gate-width (W) to gate-length (L) ratio of $K_2'$, i.e., $(W/L)=K_2'$. The MOSFET M2 has a gate-width to gate-length ratio of $K_1'$, i.e., $(W/L)=K_1'\cdot K_1'$ and $K_2'$ are both constants greater than unity.

In the current mirror subcircuit made of the MOSFETs M6, M7 and M8, gates of the MOSFETs M6, M7 and M8 are connected in common. A drain of the MOSFETs M8 is connected to the connection point of the resistor R11 and the gate of the MOSFET M1. A drain of the MOSFET M7 is connected to the drain of the MOSFET M2. The gate and a drain of the MOSFET M6 are coupled together to be connected to a drain of the MOSFET M3. Sources of the MOSFETs M6, M7 and M8 are connected in common to be applied with a supply voltage $V_{DD}$.

Each of the MOSFETs M6, M7 and M8 has a gate-width to gate-length ratio of unity, i.e., (W/L)=1.

The current mirror subcircuit composed of the MOSFETs M1 and M2 and the resistor R11 constitute a "Nagata current mirror" subcircuit. Although an additional resistor may be connected to the source of the MOSFET M1 and/or another additional resistor may be connected to the source of the MOSFET M2, only one resistor R11 is provided between the gate and the drain of the MOSFET M1 in order to represent the feature of the Nagata current mirror subcircuit remarkably in this embodiment.

In this Nagata current mirror subcircuit, a drain current $I_{11}$ of the MOSFET M1 is used as a reference to a drain current $I_{12}$ of the MOSFET M2 as an output of this subcircuit. The currents $I_{11}$ and $I_{12}$ are equal in current value to each other, i.e., $I_{11}=I_{12}$. The current $I_{12}$ is a constant current having a positive temperature coefficient. The numeral $I_{13}$ indicates a drain current of the MOSFET M3. Here, $I_{13}=I_{12}=I_{11}$ is established.

The inverse PTAT subcircuit 42 includes two n-channel MOSFETs M4 and M5 and one resistor R12 (resistance: $r_{12}$). The resistor R12 is connected between a gate of the MOSFET M4 and the ground. Sources of the MOSFETs M4 and M5 are connected to the ground. A drain of the MOSFET M4 is connected to a gate of the MOSFET M5.

The inverse PTAT subcircuit 42 further includes five p-channel MOSFETs M11, M12, M13, M14 and M15. The MOSFETs M11 and M12 constitute a current mirror subcircuit, and the MOSFETs M13, M14 and M15 constitute another current mirror subcircuit.

Gates of the MOSFETs M11 and M12 are coupled together. A drain and the gate of the MOSFET M11 are coupled together to be connected to a drain of the MOSFET M5. A drain of the MOSFET M12 is connected to the connection point of the resistor R12 and the gate of the MOSFET M4. Sources of the MOSFETs M11 and M12 are applied with the supply voltage Vcc.

Gates of the MOSFETs M13, M14 and M15 are coupled together. A drain and the gate of the MOSFET M13 are coupled together. A drain of the MOSFET M14 is connected to the drain of the MOSFET M4. Sources of the MOSFETs M13, M14 and M15 are applied with the supply voltage $V_{DD}$.

The reference current $I_{ref}$ with no temperature dependency of this Current reference circuit is taken out from a drain of the MOSFET M15.

Each of the MOSFETs M11, M12, M14 and M15 has the gate-width to gate-length ratio of unity, i.e., (W/L)=1. The MOSFET M13 has a gate-width to gate-length ratio of $K_4'$ where $K_4'$ is a constant greater than unity, i.e., $(W/L)=K_4'>1$.

In the current mirror circuit composed of the MOSFETs M11 and M12, a drain current $I_{22}$ of the MOSFET M12, which flows through the resistor R12, has a current value and a temperature coefficient that are equal to those of a drain current of the MOSFET M11, i.e., the drain current $I_{15}$ of the MOSFET M5. In other words, the MOSFET M5 is supplied with the current $I_{15}$ having the same current value and negative temperature coefficient as those of the current flowing through the resistor R12. The current flowing through the resistor R12, i.e., I22, has a negative temperature coefficient (the reason of which is shown below) and therefore, the current $I_{15}$ has the same negative temperature coefficient.

In the current mirror circuit composed of the MOSFETs M13, M14 and M15, each of drain currents of the MOSFETs M14 and M15 has a current value and a temperature coefficient that are equal to those of a drain current $I_{23}$ of the MOSFET M13. In other words, the MOSFET M14 supplies a bias current having the same current value and temperature coefficient as those of the drain current $I_{23}$ as the drain current I14. Also, a drain current of the MOSFET M15 has the same current value and temperature coefficient as those of the drain current $I_{23}$, which is the reference current $I_{ref}$ of this current reference circuit.

Since the drain current $I_{23}$ has no temperature coefficient (the reason of which is shown below), both of the drain current $I_{14}$ and the reference current $I_{ref}$ have no temperature coefficient.

The adder 43 contains two n-channel MOSFETs M9 and M10 whose drains are coupled together to be connected to the drain of the MOSFET M13 and whose sources are grounded. A gate of the MOSFET M9 is connected to the gate of the MOSFET M3 and the drain of the MOSFET Mr. A gate of the MOSFET M10 is connected to the gate of the MOSFET M5 and the drain of the MOSFET M4.

The MOSFET M9 has a gate-width to gate-length ratio of $K_3'$, i.e., $(W/L)=K_3'$, and the MOSFET M10 has a gate-width to gate-length ratio of $K_5'$, i.e., $(W/L)=K_5'$, where $K_4'$ and $K_5'$ are constants greater than unity.

The MOSFET M9 is driven by the constant current $I_{12}$ having the positive temperature coefficient through the MOSFET M3, producing the current $I_{19}$ having the positive temperature coefficient as the output of the PTAT current source 41. In other words, the drain current $I_{19}$ is the first constant current having the positive temperature coefficient produced by the PTAT current source 41.

On the other hand, the MOSFET M10 is driven by the constant current $I_{22}$ having the negative temperature coefficient through the MOSFETs M4 and M5, producing the current $I_{20}$ having the negative temperature coefficient as the output of the inverse PTAT current source 42. In other words, the drain current $I_{20}$ is the second constant current having the negative temperature coefficient produced by the inverse PTAT current source 42.

Since the drains of the MOSFETs M9 and M10 are coupled together to be connected to the drain of the MOSFET M13, the drain currents $I_{19}$ and $I_{20}$ are added to each other to cancel their positive and negative temperature coefficients with each other. Thus, the current $I_{23}$ as the sum current of the currents $I_{19}$ and $I_{20}$ has no temperature coefficient, in other words, no temperature dependence.

Since the currents $I_{14}$ and $I_{ref}$ are mirror currents of the current $I_{23}$ having no temperature coefficient, the temperature-independent current $I_{14}$ is supplied to the MOSFET M4 and at the same time, the temperature-independent current $I_{ref}$ is outputted from the drain of the MOSFET M15 as the reference current of this current reference circuit.

The reason that the PTAT current source 41 produces the constant current $I_{19}$ having the positive temperature coefficient and that the inverse PTAT current source 42 produces the constant current $I_{20}$ having the negative temperature coefficient is as follows:

Supposing that all the MOSFETs are matched in characteristic and ignoring the channel-length modulation and the body effect, a drain current $I_i'$ of each MOSFET whose gate-width to gate-length ratio (W/L) is $K_i'$ can be expressed as the following equation (7).

$$I_1=\beta(V_{GS1}-V_{TH})^2 \tag{7}$$

In the equation (7), beta is the transconductance parameter of each MOSFET, $V_{TH}$ is the threshold voltage thereof, and $V_{GSi}$ is the gate-source voltage thereof. Here, $\beta$ is expressed as $(C_{OX}/2)$ (W/L) where $\lambda$ is the effective carrier mobility, and $C_{OX}$ is the gate oxide capacitance per unit area.

Therefore, the drain current $I_2$ of the MOSFET M2 is expressed as $$I_{12}=K_1{}^1\beta(V_{GS2}-V_{TH})^2 \tag{8}$$

Also, the following equations (9) and (10) are established:

$$V_{GS2}-V_{GS1}=r_{11}I_{11} \tag{9}$$

-continued $$I_{11}=\frac{K_2}{K_1}I_{12} \tag{10}$$

Solving the equations (8), (9) and (10) provides the following expression (11):

$$I_{12}=\frac{1}{\beta r_{11}^2(K_2/K_1)}\left(1-\frac{1}{\sqrt{K_2}}\right)^2 \tag{11}$$

The expressions (10) and (11) show the relationship between the drain current $I_{11}$ as a reference current and the drain current $I_{12}$ as its mirror current.

Figure 8:
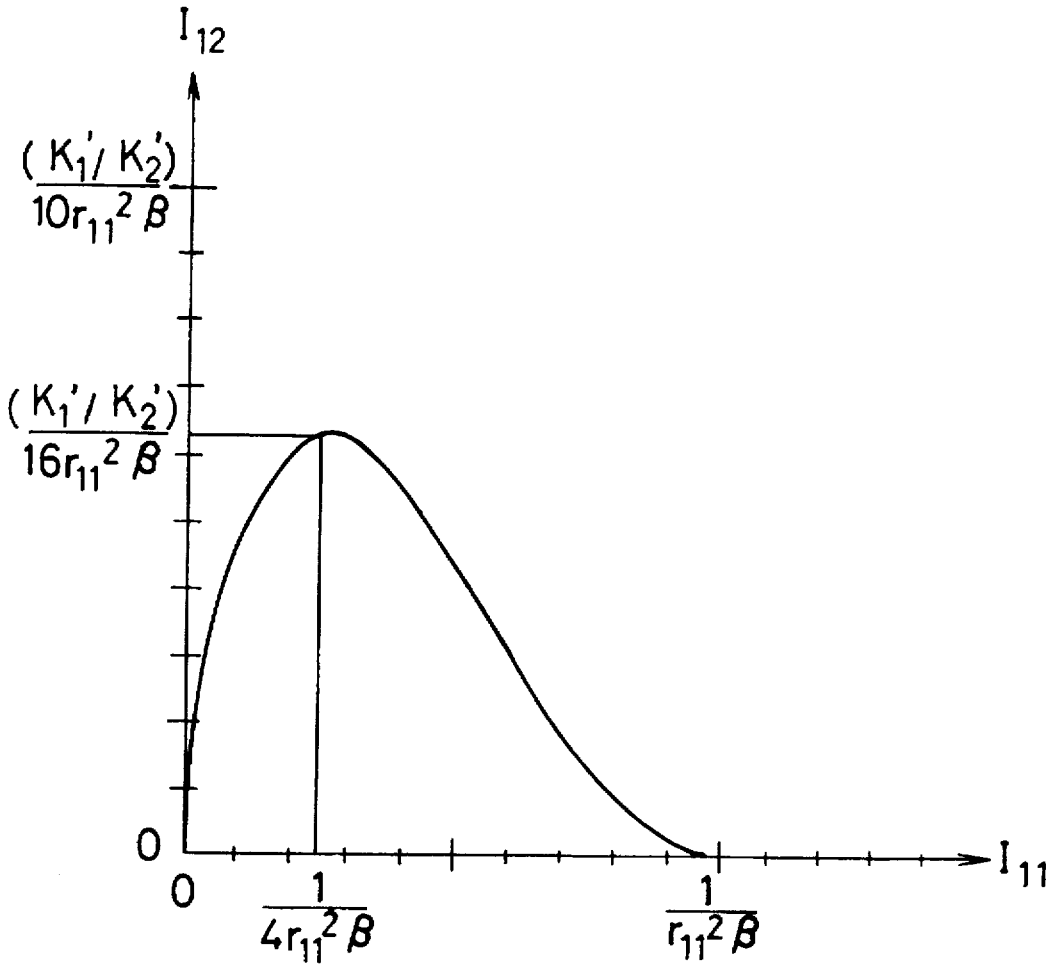
FIG. 8 is a graph showing the relationship between the currents $I_{11}$ and $I_{12}$ of the PTAT subcircuit in the current reference circuit of FIG. 5.

FIG. 8 is a graph showing the relationship between the currents $I_{11}$ and $I_{12}$ in the MOS Nagata current mirror subcircuit, which is obtained by using the expressions (10) and (11).

It is seen from FIG. 8 that the mirror current $I_{12}$ varies with respect to the reference current $I_{11}$ and that the curve of $I_{12}$ has a peak. The peak appears when $I_{11}=1/(4r_{11}{}^2\cdot\beta)$. If the current $I_{11}$ has a current value that is positioned at the peak by selecting the resistance value $r_{11}$ of the resistor R11, $I_{12}=(K_1'/K_2')/(16r_1{}^2\cdot\beta)$, and the fluctuation for the current $I_{12}$ with respect to the current $I_{11}$ becomes the least, resulting in the most stable operation of the MOS Nagata current mirror subcircuit.

Also, $I_{11}=I_{12}$ is established in this embodiment. Therefore, it is preferable that $(K_1'/K_2')=4$ because the MOS Nagata current mirror subcircuit can operate at the peak of the $I_{12}$ curve.

In the MOSFET, because the mobility $\mu$ has a temperature dependence, the transconductance parameter $\beta$ is expressed by the following equation (12):

$$\beta=\beta_0\left(\frac{T}{T_0}\right)^{-\frac{3}{2}} \tag{12}$$

where $\beta_0$ indicates a value of $\beta$ at room temperature (300 K).

Substituting the equation (12) into the equation (11) provides the following equation (13):

$$I_{12}=\frac{1}{\beta_0 r_{11}^2(K_2/K_1)}\left(\frac{T}{T_0}\right)^{\frac{3}{2}}\left(1-\frac{1}{\sqrt{K_2}}\right)^2 \tag{13}$$

Figure 7:
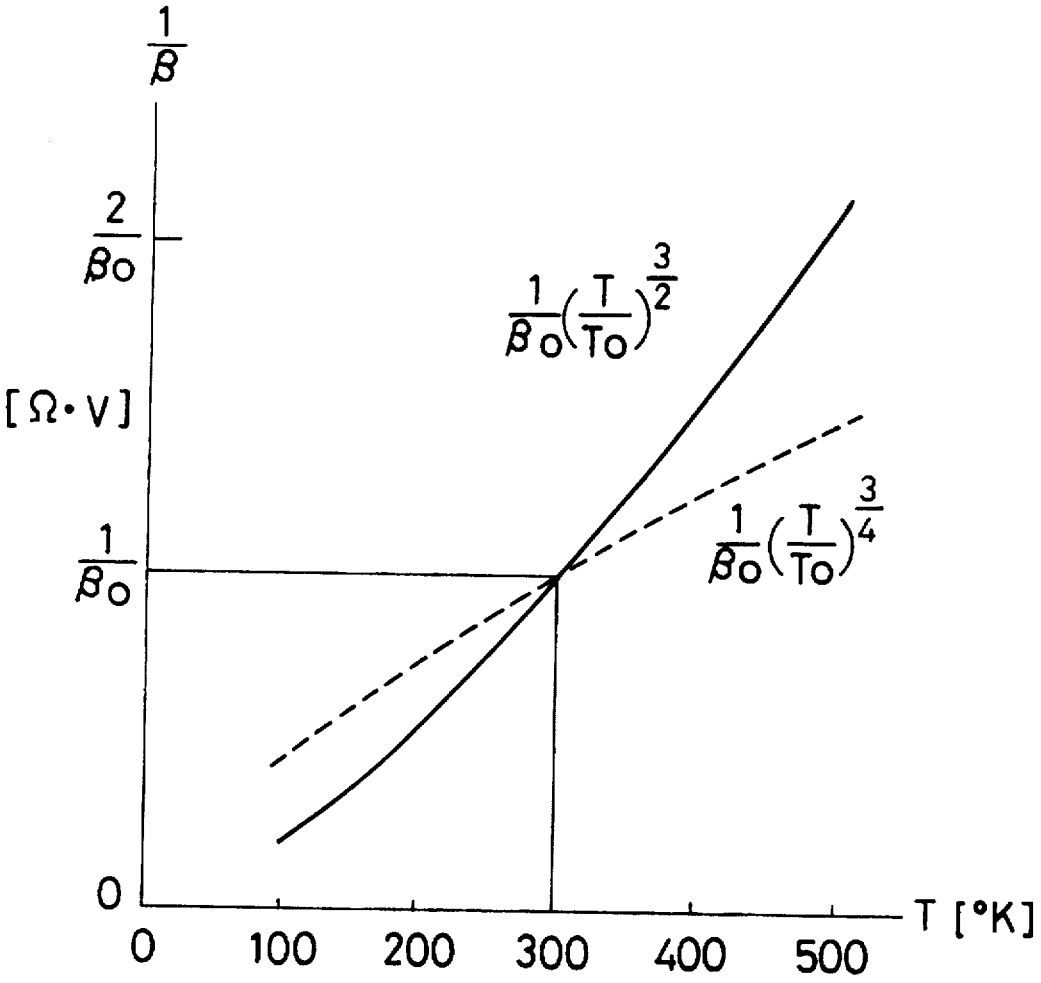
FIG. 7 is a graph showing the relationship between the absolute temperature T and the transconductance parameter β in the current reference circuit of FIG. 5.

It is seen from the solid line curve in FIG. 7 that the term $(1/\beta_0)$ $(T/T_0)^{3/2}$ in the equation (13) has a positive temperature coefficient, which is equal to +5000 ppm/deg an 300 K.

The first constant current as the output of the PTAT current source 41 is expressed by $(K_3'\cdot I_{12})$ and therefore, the first constant current has a positive temperature coefficient.

On the other hand, using the above equation (7), the drain current $I_{14}$ of the MOSFET M4 in the inverse PTAT current source is expressed as the following equation (14):

$$I_{14}=\beta(V_{GS4}-V_{TH})^2 \tag{14}$$

Solving the equation (14) provides the gate-source voltage $V_{GS4}$ of the MOSFET M4 as $$V_{GS4}=r_{12}I_{13}=\sqrt{\frac{I_{14}}{\beta}}+V_{TH} \tag{15}$$

Here, the threshold voltage $V_{TH}$ of each MOSFET has a negative temperature coefficient of about −2.3 mV/deg. Therefore, if $V_{TH0}=0.5$ V where $V_{TH0}$ indicates the value of $V_{TH}$ at 300 K, the threshold voltage $V_{TH}$ has a negative temperature coefficient of (−2.3 mV/500 mV)=−4.600 ppm/deg.

Assuming that the drain current $I_{14}$ flowing through the MOSFET M4 has no temperature coefficient, the following equation (16) is established in the above equation (15) using the above equation (12).

$$\frac{1}{\sqrt{\beta}} = \frac{1}{\sqrt{\beta_0}} \left( \frac{T}{T_0} \right)^{\frac{3}{4}} \quad (16)$$

Also, it is seen from the broken line curve in FIG. 7 that the term $(1/\beta_0)^{1/2}(T/T_0)^{3/4}$ in the equation (15) has a positive temperature coefficient of +2500 ppm/deg at 300 K, because $(3/4)\times(1/300)=+2500$ ppm/deg.

Ignoring the temperature coefficient of the resistor R12, the current $I_{22}$ flowing through the resistor R12 has a negative temperature coefficient of −3250 ppm/deg, because −4600+2500=−2100.

The second constant current as the output of the inverse PTAT current source 42 is expressed by $K_5' \cdot I_{22}$ and therefore, the second constant current has a negative temperature coefficient.

As described above, the reference current $I_{ref}$ as the output of this current reference circuit, which is equal to the currents $I_4$ and $I_{23}$, is obtained as follows:

$$I_{ref} = I_{14} = \frac{1}{K_4} (K_3 I_{12} + K_5 I_{13}) \quad (17)$$

It is seen from the equation (17) that the temperature coefficient of the reference current $I_{ref}$ can be made zero by selecting the values of the (W/L) ratios $K_3'$ and $K_5'$. Also, it is seen that the current $I_{14}$ can optionally have any current value by selecting the value of the (W/L) ratio $K_4'$.

In the current reference circuit according to the third embodiment, in consideration with the fact that the gate-source voltage of the MOSFET M4 has a negative temperature coefficient, the current $I_{22}$ having a negative temperature coefficient is produced by using the resistor R12 connected to the gate of the MOSFET M4. Then, the negative temperature coefficient of the current $I_{22}$ thus produced is transferred to the current $I_{15}$ flowing through the MOSFET M5 using the MOSFETs M11 and M12.

Similar to the above first and second embodiments employing the bipolar transistors, since the temperature-independent reference current $I_{ref}$ is produced by using the MOSFETs M4 and M5 arranged horizontally and the resistor R12, no vertically stacked are MOSFETs are required. As a result, the number of the vertically stacked MOSFETs is limited to two even if the bias subcircuit made of the MOSFETs M13 and M14 is contained, enabling to operate the current reference circuit at a lower supply voltage than that of the conventional one.

Additionally, since n- and p-channel MOSFETs are employed in the third embodiment, this current reference circuit can be provided on complementary MOS (CMOS) semiconductor integrated circuit devices.

FOURTH EMBODIMENT

Figure 6:
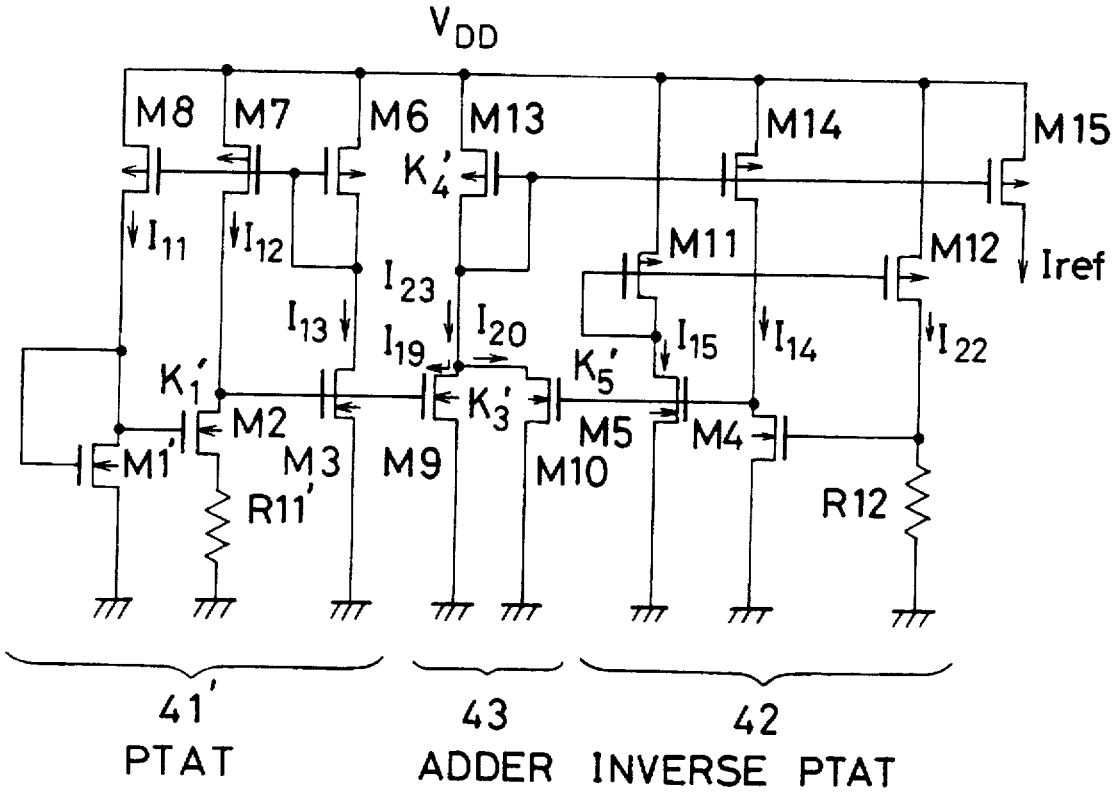
FIG. 6 is a circuit diagram of a current reference circuit composed of MOSFETs according to a fourth embodiment of the invention, which is equivalent to a circuit obtained by replacing the bipolar transistors in the circuit of FIG. 4 by MOSFETs.

A current reference circuit according to a fourth embodiment is shown in FIG. 6, which has the same configuration as that of the second embodiment except for the "Nagata current mirror" subcircuit is replaced by a "Widlar current mirror" subcircuit and that the MOSFET M8 whose (W/L) ratio is $K_2'$ is replaced by a p-channel MOSFET M8' whose (W/L) ratio is unity.

Therefore, description for the same configuration is omitted here by adding the same reference numerals to the corresponding elements for the sake of simplification.

In FIG. 6, a PTAT current source 41' includes a Widlar current mirror subcircuit composed of two n-channel MOSFETs M1' and M2 and one resistor R11' (resistance: $r_{11}'$), another current mirror subcircuit composed of three p-channel MOSFETs M6, M7 and M8', and an n-channel MOSFET M3. The resistor R11' is connected between the source of the MOSFET M2 and the ground. The resistor R11 connected to the drain of the MOSFET M1 in the third embodiment is not provided here.

The PTAT current source 41' also produces a first constant current having a positive temperature coefficient and a current value varying in proportion to the ambient absolute temperature.

The procedure or principle through which the MOS PTAT subcircuit containing the Widlar current mirror subcircuit produces such the first constant current is well-known and therefore, no description is disclosed here.

The same effects as those of the third embodiment is obtained in the fourth embodiment.

While the preferred forms of the present invention have been described, it is to be understood that modifications will be apparent to those skilled in the art without departing from the spirit of the invention. The scope of the invention, therefore, is to be determined solely by the following claims,

What is claimed is:

1. A current reference circuit comprising:

(a) a first current source for producing a first constant current having a positive temperature coefficient;

(b) a second current source for producing a second constant current having a negative temperature coefficient;

(c) an adder for adding said first constant current and said second constant current to cancel said positive temperature coefficient and said negative temperature coefficient, producing a reference current having no temperature coefficient; and (d) said second current source containing a first bipolar transistor, a second bipolar transistor, a resistor and a bias subcircuit;

said resistor being connected between a base and an emitter of said first bipolar transistor;

said emitter of said first bipolar transistor being connected to an emitter of said second bipolar transistor;

a collector of said first bipolar transistor being connected to a base of said second bipolar transistor;

said second bipolar transistor being driven by a driving current whose current value is the same as a current that flows through said resistor;

a collector current of said second bipolar transistor acting as said second constant current; and said bias subcircuit supplying said reference current to said collector of said first bipolar transistor.

2. A current reference circuit as claimed in claim 1, wherein said first current source is made of a Nagata current source.

3. A current reference circuit as claimed in claim 1, wherein said first current source is made of a Widlar current source.

4. A current reference circuit comprising:

(a) a first current source for producing a first constant current having a positive temperature coefficient;

(b) a second current source for producing a second constant current having a negative temperature coefficient;

(c) an adder for adding said first constant current and said second constant current to cancel said positive temperature coefficient and said negative temperature coefficient, producing a reference current having no temperature coefficient; and (d) said first current source containing a first bipolar transistor, a second bipolar transistor, a third bipolar transistor, a first resistor and a first bias subcircuit;

said second bipolar transistor having an emitter area of K times as large as that of said first bipolar transistor, where K is a constant;

said first resistor being connected between a base and a collector of said first bipolar transistor so that said base and said collector being connected through said first resistor;

emitters of said first bipolar transistor, said second bipolar transistor and said third bipolar transistor being connected to each other;

a collector of said first bipolar transistor being connected to a base of said second bipolar transistor;

a collector of said second bipolar transistor being connected to a base of said third bipolar transistor;

said first bias subcircuit being connected to said collector of said first bipolar transistor through said first resistor, and connected to said collectors of said second bipolar transistor and said third bipolar transistor, and supplying a first current, a second current and a third current to said first, second and third bipolar transistors, respectively;

a collector current of said second bipolar transistor acting as said first constant current; and said first constant current being taken out from said collector of said second bipolar transistor;

(e) said second current source containing a fourth bipolar transistor, a fifth bipolar transistor, a second resistor and a second bias subcircuit;

said second resistor being connected between a base and an emitter of said fourth bipolar transistor;

said emitter of said fourth bipolar transistor being connected to an emitter of said fifth bipolar transistor;

a collector of said fourth bipolar transistor being connected to a base of said fifth bipolar transistor;

said fifth bipolar transistor being driven by a driving current whose current value is the same as a current that flows through said second resistor;

a collector current of said fifth bipolar transistor acting as said second constant current; and said second bias subcircuit supplying said reference current to said collector of said fourth bipolar transistor.

5. A current reference circuit as claimed in claim 4, wherein a voltage drop made by said bias current to said first bipolar transistor from said first bias subcircuit is substantially equal to the thermal voltage.

6. A current reference circuit as claimed in claim 4, wherein said K is substantially equal to the base of the natural logarithm.

7. A current reference circuit as claimed in claim 4, wherein said K is equal to 11/4.

8. A current reference circuit comprising:

(a) a first current source for producing a first constant current having a positive temperature coefficient;

(b) a second current source for producing a second constant current having a negative temperature coefficient;

(c) an adder for adding said first constant current and said second constant current to cancel said positive temperature coefficient and said negative temperature coefficient, producing a reference current having no temperature coefficient; and (d) said first current source containing a first bipolar transistor, a third bipolar transistor, a third bipolar transistor, a first resistor and a first bias subcircuit;

said second bipolar transistor having an emitter area of K times as large as that of said first bipolar transistor, where K is a constant;

said first resistor being connected to an emitter of said second bipolar transistor;

emitters of said first bipolar transistor and said second bipolar transistor being coupled together, and said emitter of said second bipolar transistor being connected to said coupled emitters of said first and third bipolar transistors through said first resistor;

a collector and a base of said first bipolar transistor being coupled together to be connected to a base of said second bipolar transistor;

a collector of said second bipolar transistor being connected to a base of said third bipolar transistor;

said first bias subcircuit being connected to said collectors of said first, second, and third bipolar transistors, and supplying first, second and third bias currents to said first, second and third bipolar transistors, respectively;

a collector current of said second bipolar transistor acting as said first constant current; and said first constant current being taken out from said collector of said second bipolar transistor;

(e) said second current source containing a fourth bipolar transistor, a fifth bipolar transistor, a second resistor and a second bias subcircuit;

said second resistor being connected between a base and an emitter of said fourth bipolar transistor;

said emitter of said fourth bipolar transistor being connected to an emitter of said fifth bipolar transistor;

a collector of said fourth bipolar transistor being connected to a base of said fifth bipolar transistor;

said fifth bipolar transistor being driven by a driving current whose current value is the same as a current that flows through said second resistor;

a collector current of said fifth bipolar transistor acting as said second constant current; and said second bias subcircuit supplying said reference current to said collector of said fourth bipolar transistor.

9. A current reference circuit as claimed in claim 8, wherein a voltage drop made by said bias current to said first bipolar transistor from said first bias subcircuit is substantially equal to the thermal voltage.

10. A current reference circuit as claimed in claim 8, wherein said K is substantially equal to the base of the natural logarithm.

11. A current reference circuit as claimed in claim 8, wherein said K is equal to 11/4.

12. A current reference circuit comprising:

(a) a first current source for producing a first constant current having a positive temperature coefficient;

(b) a second current source for producing a second constant current having a negative temperature coefficient;

(c) an adder for adding said first constant current and said second constant current to cancel said positive temperature coefficient and said negative temperature coefficient, producing a reference current having no temperature coefficient; and (d) said second current source containing a first FET, a second FET, a resistor and a bias subcircuit;

said resistor being connected between a gate and a source of said first FET;

said source of said first FET being connected to a source of said second FET;

a drain of said first FET being connected to a gate of said second FET;

said second FET being driven by a driving current whose current value is the same as a current that flows through said resistor;

a drain current of said second FET acting as said second constant current; and said bias subcircuit supplying said reference current to said drain of said first FET.

13. A current reference circuit as claimed in claim 12, wherein said first current source is made of a Nagata current source.

14. A current reference circuit as claimed in claim 12, wherein said first current source is made of a Widlar current source.

15. A current reference circuit comprising:

(a) a first current source for producing a first constant current having a positive temperature coefficient;

(b) a second current source for producing a second constant current having a negative temperature coefficient;

(c) an adder for adding said first constant current and said second constant current to cancel said positive temperature coefficient and said negative temperature coefficient, producing a reference current having no temperature coefficient; and (d) said first current source containing a first FET, a second FET, a third FET, a first resistor and a first bias subcircuit;

said first resistor being connected between a gate and a drain of said first FET so that said gate and said drain being connected through said first resistor;

sources of said first FET, said second FET and said third FET being connected to each other;

a drain of said first FET being connected to a gate of said second FET;

a drain of said second FET being connected to a gate of said third FET;

said first bias subcircuit being connected said drain of said first FET through said first resistor, and being connected to said drains of said second FET and said third FET, and supplying first, second and third currents to said first, second and third FETs, respectively;

a drain current of said second FET acting as said first constant current; and said first constant current being taken out from said drain of said second FET;

(e) said second current source containing a fourth FET, a fifth FET, a second resistor and a second bias subcircuit;

said second resistor being connected between a Gate and a source of said fourth FET;

said source of said fourth FET being connected to a source of said fifth FET;

a drain of said fourth FET being connected to a gate of said fifth FET;

said fifth FET being driven by a driving current whose current value is the same as a current that flows through said second resistor;

a drain current of said fifth FET acting as said second constant current; and said second bias subcircuit supplying said reference current to said drain of said fourth FET.

16. A current reference circuit as claimed in claim 15, wherein said second FET has a gate-width (W) to gate-length (L) ratio (W/L) of four times as large as that of said first FET.

17. A current reference circuit comprising:

(a) a first current source for producing a first constant current having a positive temperature coefficient;

(b) a second current source for producing a second constant current having a negative temperature coefficient;

(c) an adder for adding said first constant current and said second constant current to cancel said positive temperature coefficient and said negative temperature coefficient, producing a reference current having temperature coefficient; and (d) said first current source containing a first FET, a second FET, a third FET, a first resistor and a first bias subcircuit;

said first resistor being connected to a source of said second FET;

sources of said first FET and said third FET being coupled together, and said source of said second FET being connected to said coupled sources of said first and third FETs through said first resistor;

a drain and a gate of said first FET being coupled together to be connected to a gate of said second FET;

a drain of said second FET being connected to a gate of said third FET;

said first bias subcircuit being connected to said drains of said first, second and third FETs, and supplying first, second, and third currents to said first, second and third FETs, respectively;

a drain current of said second FET acting as said first constant current; and said first constant current being taken out from said drain of said second FET;

(e) said second current source containing a fourth FET, a fifth FET, a second resistor and a second bias subcircuit;

said second resistor being connected between a gate and a source of said fourth FET;

said source of said fourth FET being connected to a source of said fifth FET;

a drain of said fourth FET being connected to a gate of said fifth FET;

said fifth FET being driven by a driving current whose current value is the same as a current that flows through said second resistor;

a drain current of said fifth FET acting as said second constant current; and said second bias subcircuit supplying said reference current to said drain of said fourth FET.

18. A current reference circuit as claimed in claim 17, wherein said second FET has a gate-width (W) to gate-length (L) ratio (W/L) of four times as large as that of said first FET.

* * * * *

UNITED STATES PATENT AND TRADEMARK OFFICE

CERTIFICATE OF CORRECTION

PATENT NO. : 5,604,427
DATED : February 18, 1997
INVENTOR(S) : Katsuji KIMURA

It is certified that error appears in the above-indentified patent and that said Letters Patent is hereby corrected as shown below:

Column 10, line 31, delete " $\Delta_F$ " and insert -- $\alpha_F$ --.

Column 10, line 47, delete " $I_1$ " and insert -- $I_2$ --.

Column 11, line 27, delete " -2mv " and insert -- -2mV --.

Column 15, line 56, delete " $\lambda$ " and insert -- $\mu$ --.

Column 16, line 21, delete " $16r_1$ " and insert -- $16r_{11}$ --.

Column 16, line 44, delete " an " and insert -- at --.

Signed and Sealed this

Twenty-eighth Day of October, 1997

*Attest:*

*Attesting Officer*

BRUCE LEHMAN

*Commissioner of Patents and Trademarks*